US006640360B2

(12) United States Patent
Hornbach et al.

(10) Patent No.: US 6,640,360 B2
(45) **Date of Patent: *Nov. 4, 2003**

(54) BED SIDERAIL

(75) Inventors: David W. Hornbach, Brookville, IN (US); Robert Mark Zerhusen, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/114,628

(22) Filed: Apr. 2, 2002

(65) Prior Publication Data

US 2002/0095724 A1 Jul. 25, 2002

Related U.S. Application Data

(63) Continuation of application No. 09/528,464, filed on Mar. 17, 2000, now Pat. No. 6,363,552.

(51) Int. Cl.[7] ..... A47C 21/08
(52) U.S. Cl. ..... 5/425; 5/428; 5/430
(58) Field of Search ..... 5/425–430

(56) References Cited

U.S. PATENT DOCUMENTS

| | | | | | |
|---|---|---|---|---|---|
| 2,722,017 | A | * | 11/1955 | Burst et al. | 5/428 |
| 3,585,659 | A | * | 6/1971 | Burst et al. | 5/100 |
| 3,624,847 | A | * | 12/1971 | Murcott | 5/429 |
| 3,823,428 | A | * | 7/1974 | Whyte | 5/429 |
| 3,905,591 | A | * | 9/1975 | Schorr et al. | 5/425 |
| 3,932,903 | A | * | 1/1976 | Adams et al. | 318/65 |
| 4,747,171 | A | * | 5/1988 | Einsele et al. | 5/425 |
| 5,689,839 | A | * | 11/1997 | Laganiere et al. | 5/425 |
| 6,363,552 | B1 | * | 4/2002 | Hornbach et al. | 5/425 |

* cited by examiner

*Primary Examiner*—Michael F. Trettel
(74) *Attorney, Agent, or Firm*—Bose McKinney & Evans LLP

(57) ABSTRACT

A bed is provided having a bedframe, a first pair of siderails, and a second pair of siderails. The bedframe includes an articulating deck having first and second sections that move relative to each other. The first pair of the siderails is coupled to the second section of the deck to move therewith. At least one pair of the siderails is configured to move relative to the other pair of siderails to compensate for movement of the first pair of siderails with the second section of the deck.

68 Claims, 6 Drawing Sheets

BED SIDERAIL

This application is a continuation of U.S. patent application Ser. No. 09/528,464, now U.S. Pat. No. 6,363,552, to Hornbach et al., filed Mar. 17, 2000, the disclosure of which is expressly incorporated by reference herein.

BACKGROUND AND SUMMARY OF THE INVENTION

The present invention relates to a bed, and particularly to a bed having barriers. More particularly, the present invention relates to a hospital bed or a patient-care bed which includes siderails that move relative to each other.

It is known to provide beds having a support surface which can be manipulated to adjust the position of the person on the support surface. It is also known to provide barriers such as siderails, headboards, and footboards on these beds. When the support surfaces of these beds are manipulated to adjust the position of the person on the support surfaces, the barriers move relative to each other and often a gap between the barriers changes in dimension as the barriers are moved.

According to the present invention, a patient support is provided including a frame, a mattress, and a siderail, the frame includes a deck support and a deck. The mattress is supported by the deck. The siderail is supported by the frame. The siderail includes a rail member, a rail support configured to support the rail member and permit raising and lowering of the rail member relative to the mattress, and a slide configured to support the rail support and slide relative to the frame between first and second positions.

According to another aspect of the present invention, another patient support is provided. The patient support includes a frame, a mattress, and first and second barriers. The frame includes a deck support and an articulating deck movable between first and second configurations. The mattress is supported by the articulating deck. The first and second barriers are configured to block egress of a patient from the mattress. The patient support further includes means for moving the first barrier relative to the frame to compensate for movement between the first and second barriers caused by movement of the articulating deck between the first and second configurations.

According to another aspect of the present invention, another patient support is provided including a frame, a mattress, and a siderail. The frame includes a deck support and a deck. The deck is movable between first and second configurations. The deck includes first and second sections. The first section of the deck moves relative to the second section of the deck during movement of the deck between the first and second configurations. The mattress is supported by the deck. The siderail is supported by the frame and is configured to move relative to the frame during movement of the deck between the first and second positions.

Additional features of the disclosure will become apparent to those skilled in the art upon consideration of the following detailed description when taken in conjunction with the accompanying drawings.

BRIEF DESCRIPTION OF THE DRAWINGS

The detailed description particularly refers to the accompanying figures in which.

DETAILED DESCRIPTION OF THE INVENTION

Figure 1:
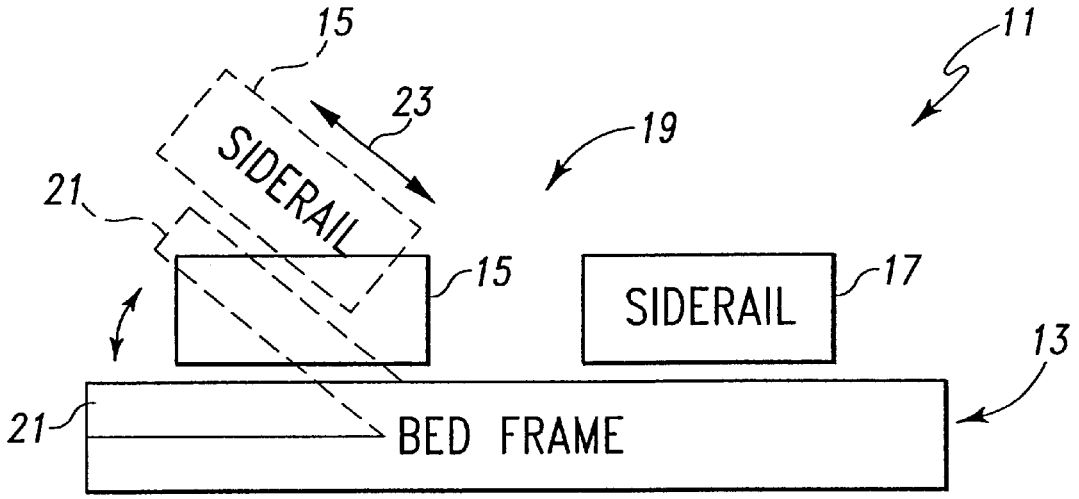
FIG. 1 is a diagrammatic view of a bed showing the bed including a bedframe and a pair of siderails defining a gap therebetween, a portion of the bedframe being moveable between a first position and a second position (in phantom), one of the siderails moving with the portion of the bedframe, and said siderail moving relative to the portion of the bedframe during movement of the portion of the bedframe.

A bed 11 according to the present disclosure is shown diagrammatically in FIG. 1. Bed 11 includes a bedframe 13 and first and second siderails 15, 17. First siderail 15 is movably coupled to bedframe 13 and second siderail 17 is coupled to bedframe 13 to cooperate with first siderail 15 to define a gap 19 therebetween.

A portion 21 of bedframe 13 is moveable between a first position and a second position shown in phantom. First siderail 15 is configured to move with portion 21 of bedframe 13 so that first siderail 15 moves relative to second siderail 17. During or after the initial relative to movement of first and second siderails 15, 17, first siderail 15 moves relative to second siderail 17 in direction 23 to compensate for the initial relative movement. This compensatory movement in direction 23 aids in maintaining gap 19 substantially constant.

Figure 2:
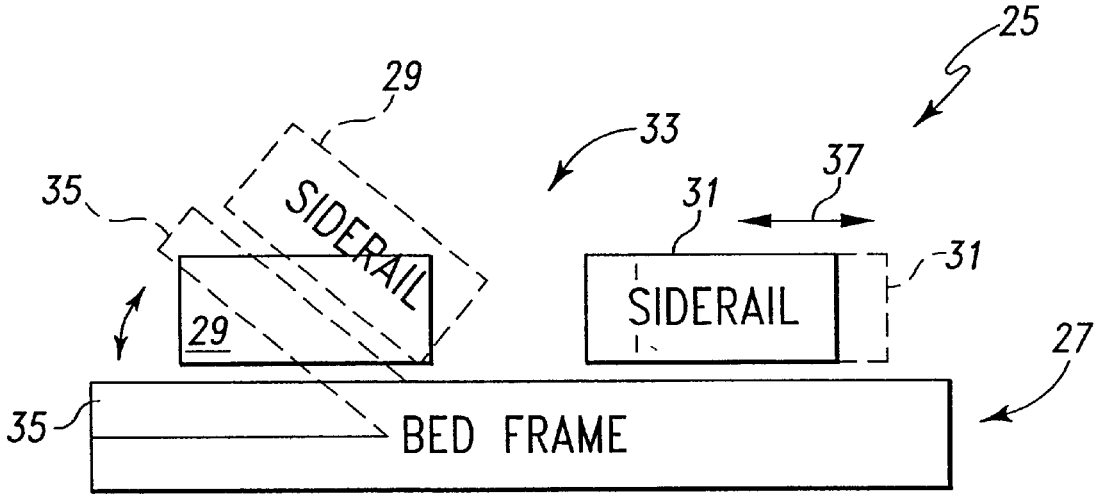
FIG. 2 is a diagrammatic view of another bed showing the bed including a bedframe and a pair of siderails defining a gap therebetween, a portion of the bedframe being moveable between a first position and a second position (in phantom), one of the siderails moving with the portion of the bedframe, and the other siderail moving relative to the bedframe during movement of the portion of the bedframe.

A bed 25 according to another embodiment of the present disclosure is shown diagrammatically in FIG. 2. Bed 25 includes a bedframe 27 and first and second siderails 29, 31. Second siderail 31 is moveably coupled to bedframe 27 and first siderail 29 is coupled to bedframe 13 to cooperate with second siderail 31 to define a gap 33 therebetween.

A portion 35 of bedframe 27 is moveable between a first position and a second position shown in phantom. First siderail 29 is configured to move with portion 35 of bedframe 27 so that first siderail 29 moves relative to second siderail 31. During or after the initial relative movement of first and second siderails 29, 31, second siderail 31 moves relative to first siderail 29 in direction 37 to compensate for the initial relative movement. This compensatory movement in direction 37 aids in maintaining gap 33 substantially constant.

Figure 3:
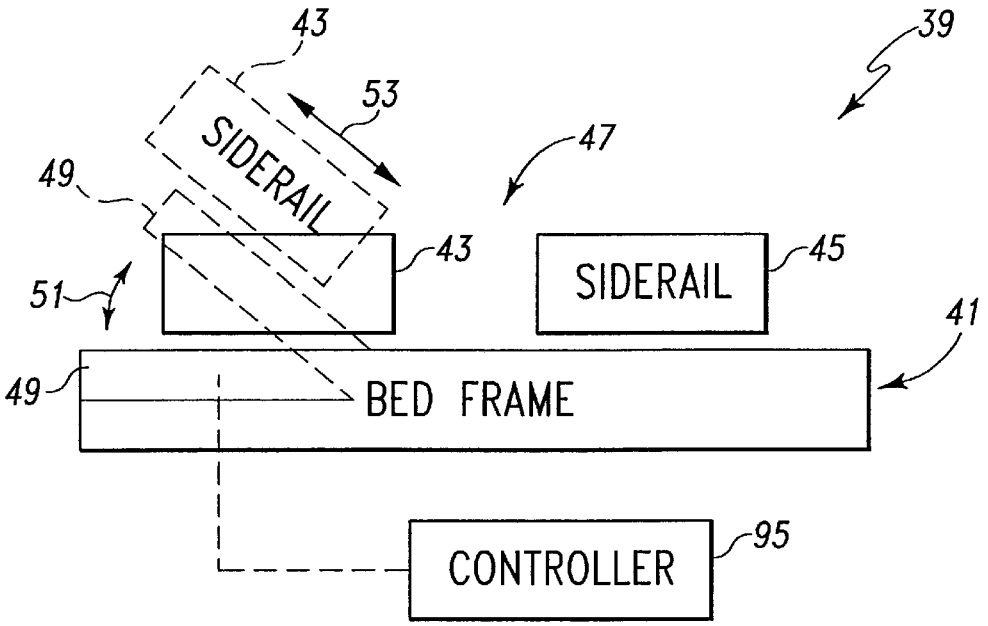
FIG. 3 is a diagrammatic view of another bed showing the bed including a bedframe, first and second siderails, and a controller, a portion of the bedframe rotating between a first position and a second position (in phantom), the first siderail rotating with the portion of the bedframe, and the controller being coupled to the first siderail to coordinate movement of the first siderail relative to the bedframe as the first siderail rotates relative to the bedframe.

A bed 39 according to another embodiment of the present disclosure is shown in FIG. 3. Bed 39 includes a bedframe 41, a first siderail 43 coupled to bedframe 41, a second siderail 45 coupled to bedframe 41, and a controller 95 coupled to first siderail 43. First and second siderails 43, 45 cooperate to define a gap 47 therebetween.

A portion 49 of bedframe 41 is moveable between a first position and a second position shown in phantom. First siderail 43 is configured to move with portion 49 of bedframe 41 in direction 51 so that first siderail 43 moves relative to second siderail 45. Controller 95 accounts for this initial movement of first siderail 43 in direction 51 and coordinates a sliding, pivoting, or other compensating movement of first siderail 43 in direction 53 so that gap 47 remains substantially constant.

Figure 4:
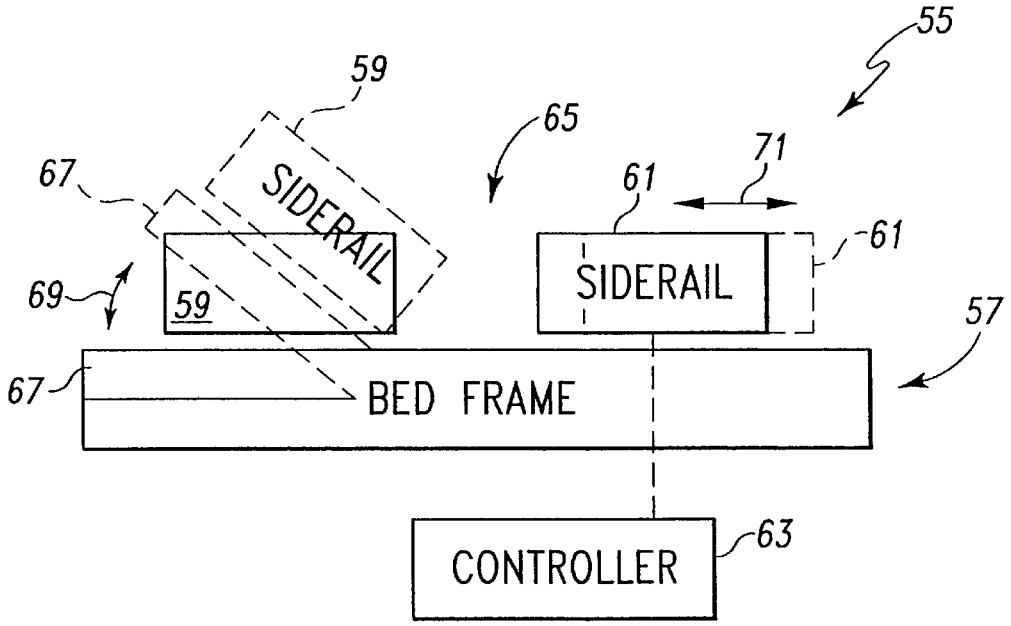
FIG. 4 is a diagrammatic view of another bed showing the bed including a bedframe, first and second siderails, and a controller, a portion of the bedframe rotating between a first position and a second position (in phantom), the first siderail rotating with the portion of the bedframe, and the controller being coupled to the second siderail to coordinate movement of the second siderail relative to the bedframe as the first siderail rotates relative to the bedframe.

A bed 55 according to another embodiment of the present disclosure is shown in FIG. 4. Bed 55 includes a bedframe 57, a first siderail 59 coupled to bedframe 57, a second siderail 61 coupled to bedframe 57, and a controller 63 coupled to second siderail 61. First and second siderails 59, 61 cooperate to define a gap 65 therebetween.

A portion 67 of bedframe 57 is moveable between a first position and a second position shown in phantom. First siderail 59 is configured to move with portion 67 of bedframe 57 in direction 69 so that first siderail 59 moves relative to second siderail 61. Controller 63 accounts for this initial movement of first siderail 59 in direction 69 and coordinates a sliding, pivoting, or other compensating movement of second siderail 61 in direction 71 so that gap 65 remains substantially constant.

According to a preferred embodiments of the present disclosure, the controllers are exclusively mechanical and includes a linkage system for coordinating the relative movement of the siderails. According to alternative embodiments, the controllers include electric components including such devices as motors, controls, processors, sensors, or electric actuators. Furthermore, the controllers may be pneumatic including such devices as pneumatic actuators, controls, sensors, or reservoirs. Other configurations of controllers may also be used.

Figure 5:
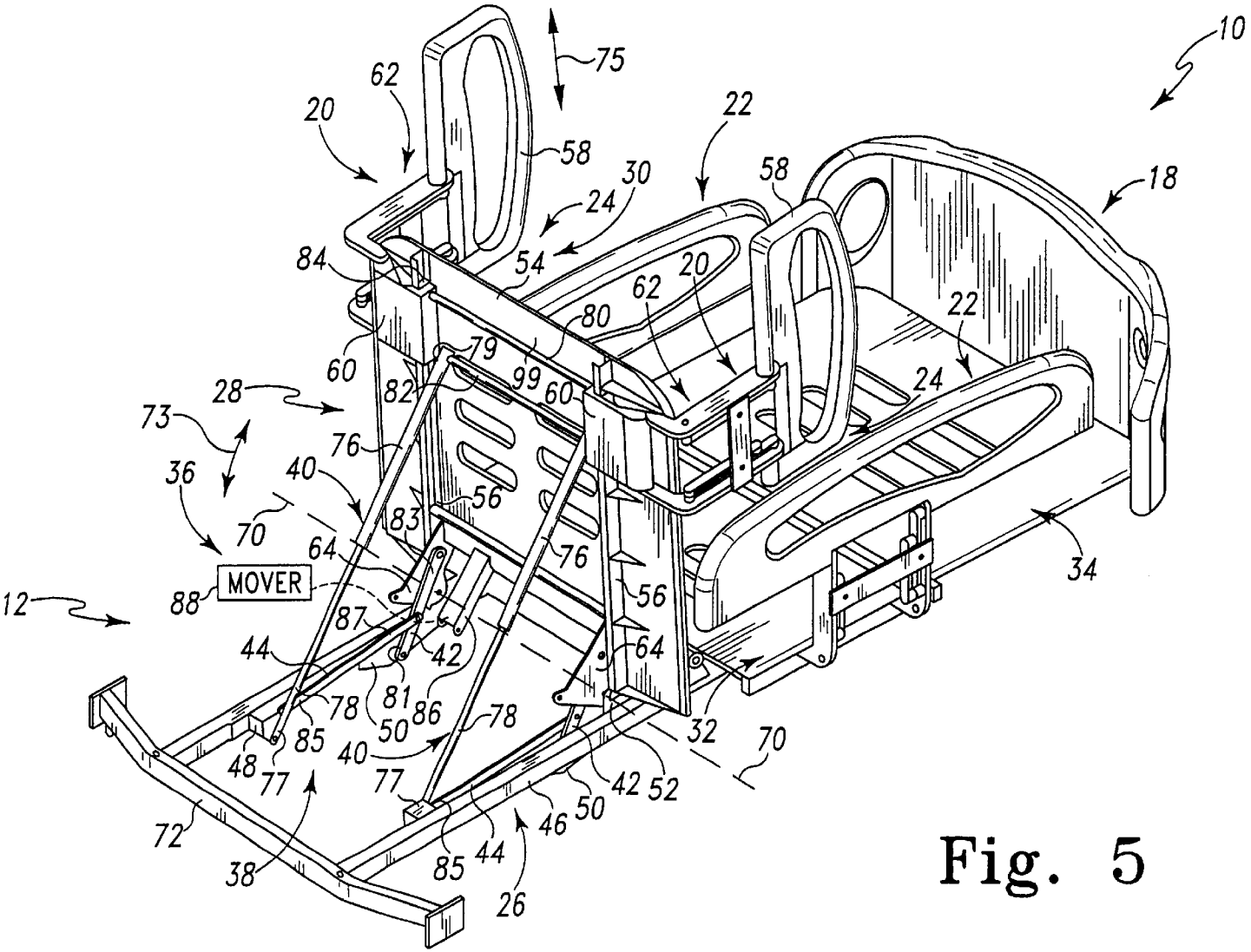
FIG. 5 is a perspective view of a preferred embodiment bed showing a bedframe (with portions removed for clarity) including an intermediate frame and an articulating deck coupled to the intermediate frame, the articulating deck including a head section positioned in a substantially vertical position and thigh and foot sections positioned in substantially horizontal positions, the bed further including a linkage system configured to control movement of head end siderails along the head section of the articulating deck during movement of the head section of the deck relative to the intermediate frame member.
Figure 6:
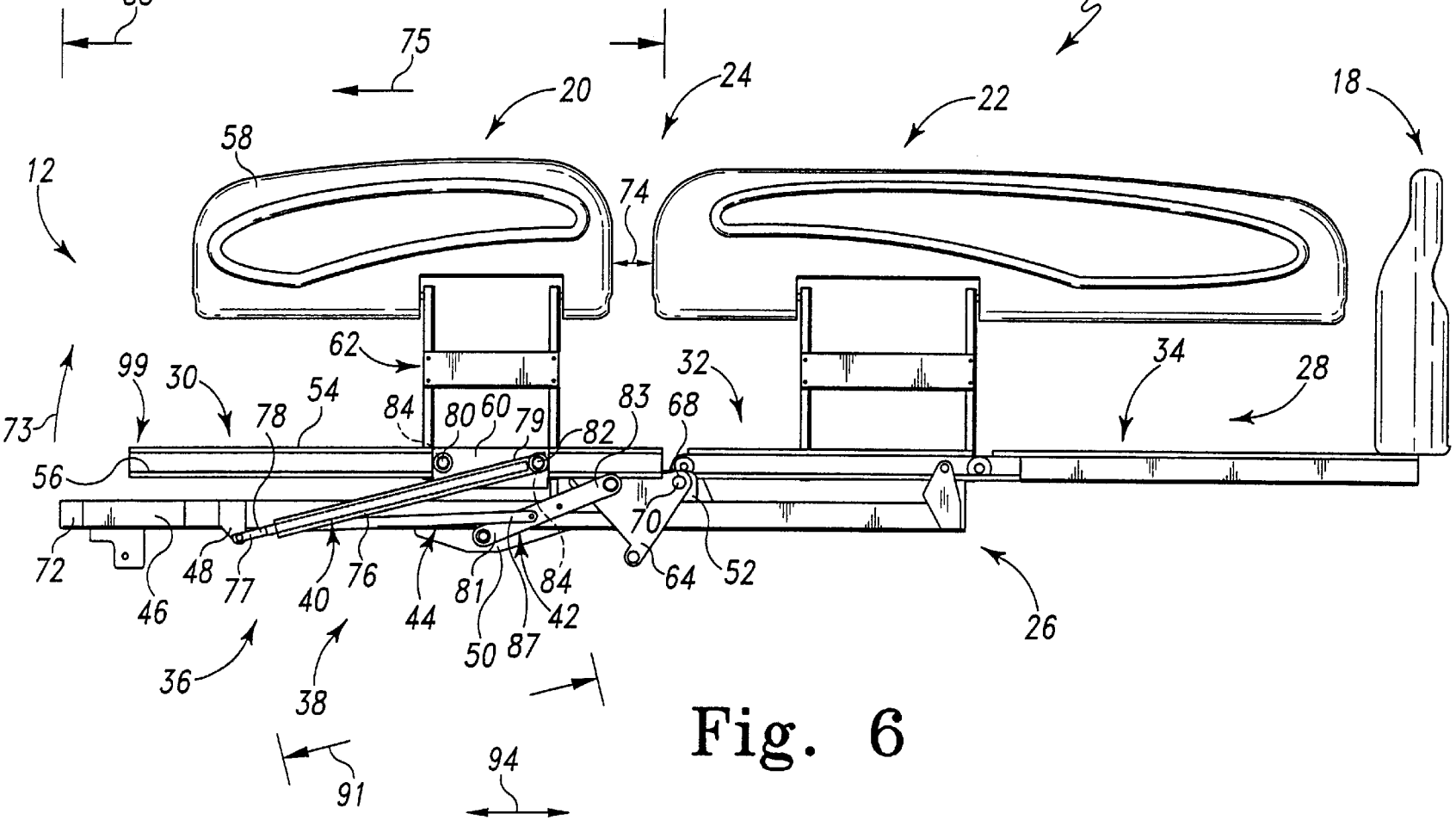
FIG. 6 is a side elevation view of the bed of FIG. 5 showing the head section of the articulating deck in a substantially horizontal position with the head end siderails positioned near a foot end of the head section of the deck.
Figure 7:
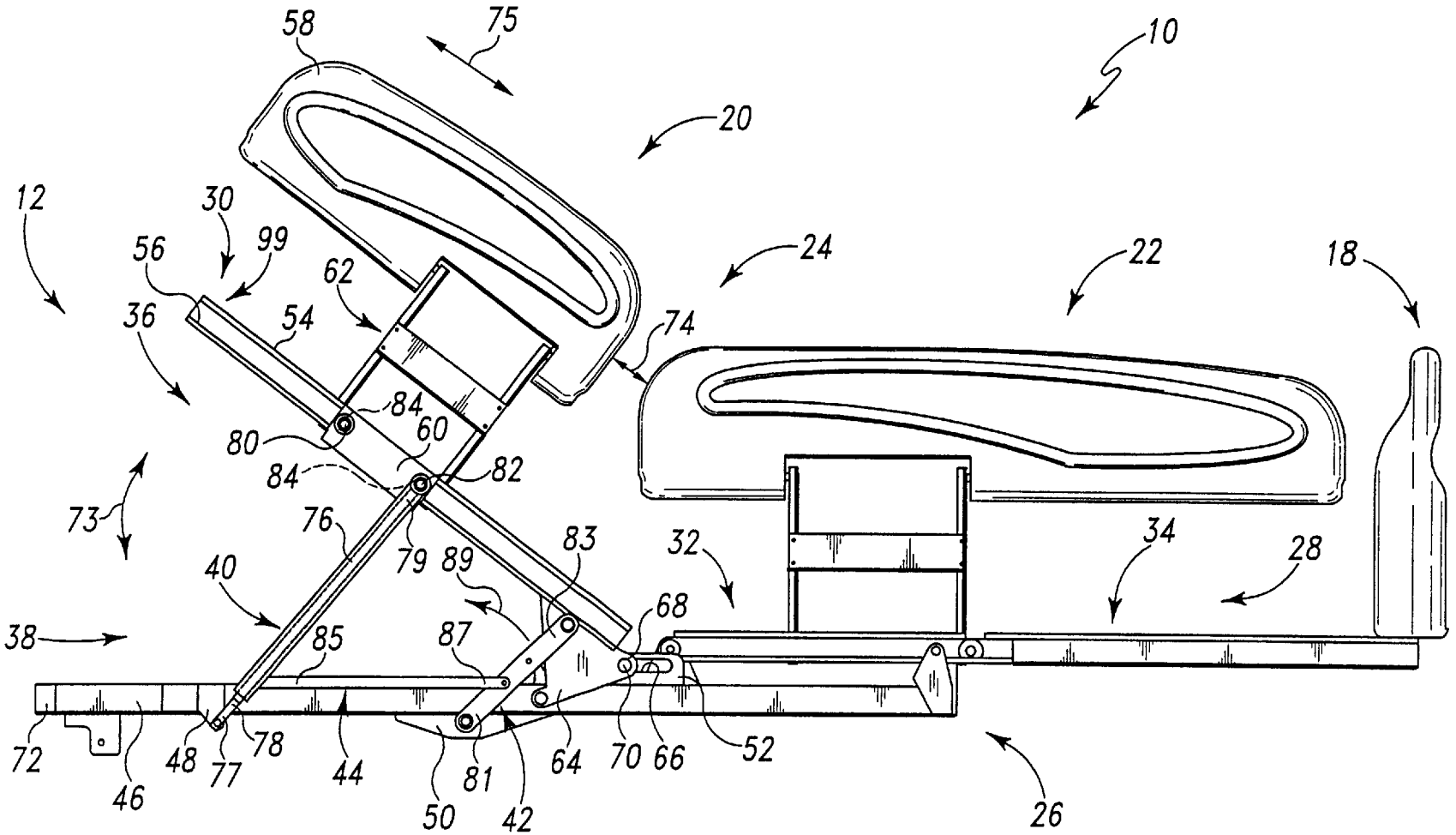
FIG. 7 is a view similar to FIG. 6 showing the head section of the deck in an intermediate position with the head end siderails moved toward the head end of the head section to a position between the head and foot ends of the head section of the deck.
Figure 8:
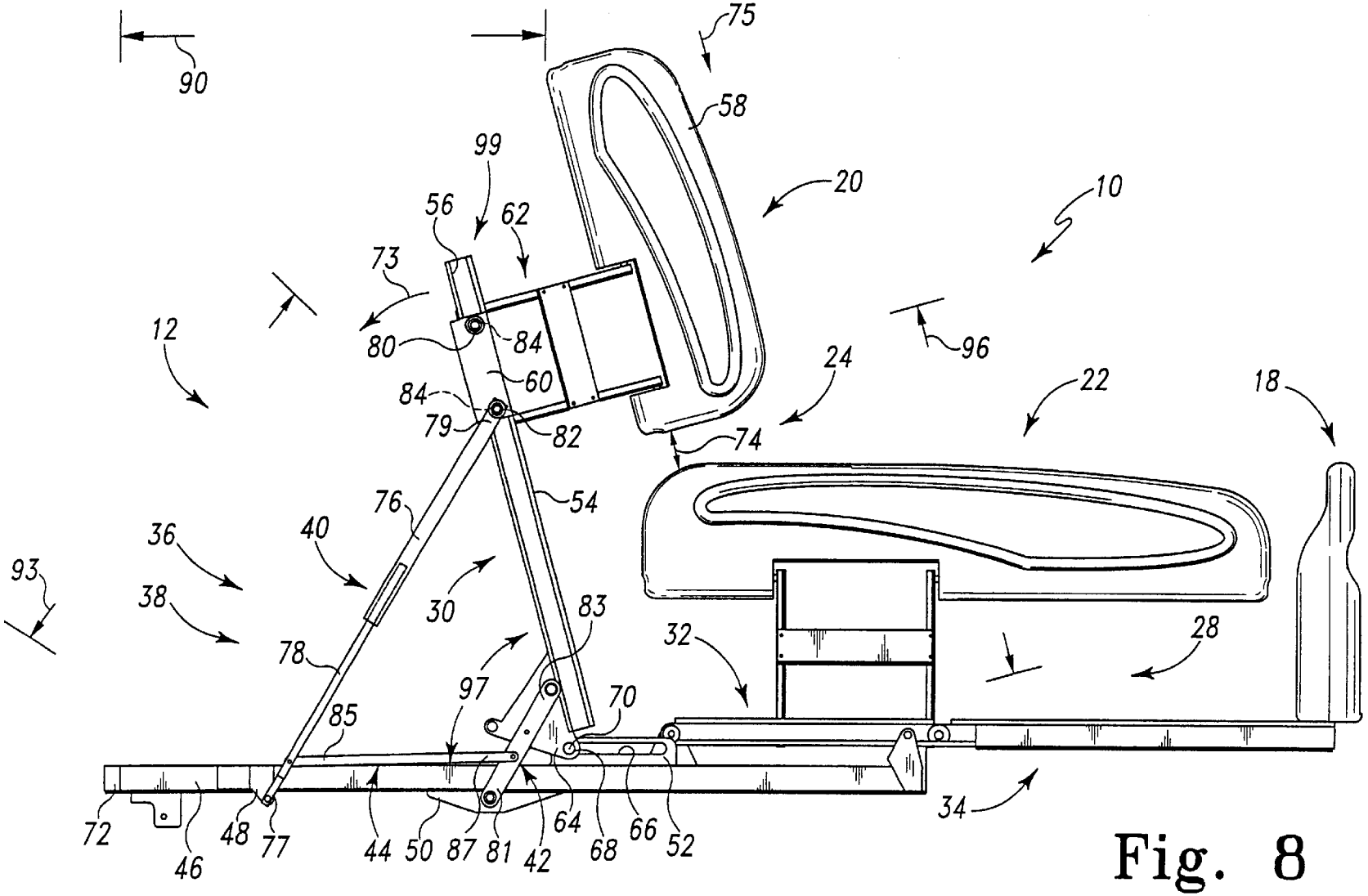
FIG. 8 is a view similar to FIGS. 6 and 7 showing the head section of the deck in the substantially vertical position with the head end siderails moved toward the head end of the head section to a position near the head end of the head section.

A presently preferred bed 10 is shown in FIG. 5. Bed 10 includes a bedframe 12 and several barriers such as a headboard 16, a footboard 18, a pair of head end siderails 20, and a pair of foot end siderails 22. All of these barriers are coupled to bedframe 12. As shown in FIGS. 6–8, siderails 20, 22 cooperate to define a pair of gaps 24 therebetween.

Bedframe 12 is configured to manipulate a mattress (not shown) into several configurations such as a bed position, as shown in FIG. 6, and a seated position as shown in FIG. 7. As bedframe 12 moves between these positions, head end siderails 20 pivot relative to foot end siderails 22 in directions 73. As shown in FIGS. 6–8, gaps 24 between head and foot end siderails 20, 22 remain substantially constant as head end siderails 20 pivot relative to foot end siderails 22. Gaps 24 remain substantially constant because head end siderails 20 slide in a direction 75 to compensate for the pivoting movement in direction 73 as shown in FIG. 7.

Bedframe 12 includes a deck support 26 and a deck 28 coupled to deck support 26 to support the mattress. Deck support 26 is configured to raise and lower deck 28 and to position deck 28 in the Trendelenburg and reverse-Trendelenburg positions. Further description of deck support 26 is provided in U.S. Pat. No. 5,715,548 to Weismiller, et al., the disclosure of which is expressly incorporated by reference herein.

Deck 28 is configured to articulate between several positions. As shown in FIG. 6, deck 28 is positioned in a bed position so that so that deck 28 is substantially flat. Deck 28 is also configured to move to a seated position, as shown in FIG. 8, in which deck 28 has an L-shape permitting a patient to sit upright on bed 10. Deck 28 includes a head section 30, a seat section 32 pivotably coupled to deck support 26, and a foot section 34 pivotably coupled to seat section 32. As shown in FIGS. 6–8, head section 30 is configured to pivot between a first substantially horizontal position and a second substantially vertical position. While in the first position, shown in FIG. 6, head section 30 and deck support cooperate to define a first angle therebetween of about 0° and while in the second position, as shown in FIG. 8, head section 30 and deck support cooperate to define a second angle 97 therebetween of about 75°.

Bed 10 further includes a mover 86 configured to move head sections 30 between the first and second positions. As shown in FIG. 5, head section 30 of deck 28 further includes an mover bracket 86 to which mover 88 is coupled to power the rotation of head section 30. According to the presently preferred embodiment of the present disclosure, mover 88 is a pneumatic actuator. According to alternative embodiments, the mover may be an electric actuator, a motor, or any other device that provides power to articulate the deck.

Head end siderails 20 are coupled to head section 30 of deck 28 so that as head section 30 pivots in direction 73 during articulation of deck 28, head end siderails 20 also pivot in direction 73. To maintain a constant gap between head and foot end siderails 20, 22, the initial pivoting movement of the head end siderails 20 is compensated for by sliding head end siderails 20 relative to head section 30 of deck 28. According to alternative embodiments of the disclosure, other types of movement other than sliding are used to compensate for the initial movement of the siderail.

According to the preferred embodiment of the present disclosure, bed 10 also includes a controller 36 that coordinates the sliding movement of head end siderails 20 relative to head section 30 of deck 28 as head section 30 and head end siderails 20 pivot relative to deck support 26. In the illustrated embodiment, controller 36 includes a linkage system 38 coupled to deck support 26, head end siderails 20, and head section 30 of deck 28. According to alternative embodiments, the controller includes electric components including such devices as motors, controls, processors, sensors, or electric actuators. Furthermore, the controller may be pneumatic including such devices as pneumatic actuators, controls, sensors, or reservoirs. Other configurations of controllers may also be used.

Linkage system 38 includes first, second, and third links 40, 42, 44. Deck support 26 includes an intermediate frame member 46, first downwardly extending flanges 48 coupled to intermediate frame member 46, second downwardly extending flanges 50 coupled to intermediate frame member 46, and upwardly extending flanges 52 coupled to intermediate frame 46. Head section 30 of deck 28 includes a substantially flat panel 54, a pair of channels 56 coupled to panel 54, and downwardly extending triangle-shaped flanges 64 coupled to panel 54 and channels 56 as shown, for example, in FIG. 5.

Head end siderails 20 include a pair of rail members 58, a pair of shuttles 60, and a pair of linkages 62 pivotably coupling rail members 58 to shuttle 60. A suitable set of linkages and rail members is described in U.S. Pat. No. 5,715,548.

First links 40 include first ends 77 pivotably coupled to respective first downwardly extending flanges 48 of deck support 26 and second ends 79 pivotably coupled to respective shuttles 60. Second links 42 include first ends 81 pivotably coupled to respective second downwardly extending flanges 50 of deck support 26 and second ends 83 pivotably coupled to respective triangular flanges 64 of head section 30. Third links 44 include first ends 85 pivotably coupled to respective first links 40 and second ends 87 pivotably coupled to respective second links 42.

As shown in FIG. 8, upwardly extending flanges 52 of deck support 26 are formed to include slots 66. Head section 30 of deck 28 includes pins 68 coupled to respective flanges 64 and positioned in respective slots 66 that permit head section 30 to rotate about an axis of rotation 70 during movement of head section 30 between the horizontal and substantially vertical positions. As head section 30 rotates, second links 42 force pins 68 to slide in slots 66 so that axis of rotation 70 moves closer to a head end 72 of deck support 26. Thus, head section 30 is both pivotably and slidably coupled to deck support 26.

As head section 30 rotates from the flat position to the substantially vertical position in direction 73, second links 42 rotate in a counterclockwise direction 89 as shown in FIGS. 6–8. Third links 44 transmit this counterclockwise rotation from respective second links 42 to respective first links 40, as shown in FIGS. 6–8, so that first and second links 40, 42 remain substantially parallel as head section 30 rotates from the flat position to the substantially vertical position. Thus, third links 44 fix the angular position of first links 40 to the angular position of second links 42. As second links 42 rotate due to the rotation of head section 30, first links 40 follow the same rotation.

As first links 40 rotate, they push shuttles 60 along channels 56 of head section 30 so that rail members 58 slide near a head end 83 of head section 30. This coordinated movement of head end siderail 20 relative to head section 30 maintains gap 24 at a substantially constant width as head end siderails 20 pivot in direction 73. Thus, as head section 30 rotates about axis of rotation 70, head end siderails 20 remain spaced apart from foot end siderails 22 by a substantially constant distance 74 as shown in FIGS. 6–8.

First links 40 have a variable length so that as head section 30 rotates, the overall lengths of first links 40 change. First links 40 are telescopic and include first link members 76 pivotably coupled to respective shuttles 60 and second link members 78 pivotably coupled to respective downwardly extending flanges 48 and slidably received in respective first links 76. During rotation of first links 40, second link members 78 slide relative to first link members 76 so that the overall length of first links 40 change. For example, as shown in FIG. 6, first link 40 has a first length 91 and, as shown in FIG. 8, first link 40 has a second length 93 that is greater than first length 91.

The movement of shuttles 60 is coordinated by a pair of rods 80, 82 extending between shuttles 60. Each first link member 76 of first links 40 is pivotably coupled to respective ends of rod 80 as shown in FIG. 5. Each rod 80, 82 includes a pair of rollers 84 coupled to the respective ends and positioned in channels 56 so that shuttles 60 slide smoothly along channels 56.

In operation, as head section 30 rotates about axis of rotation 70, head end siderails 20 also rotate about axis of rotation 70, as shown in FIGS. 6–8. During this rotation, axis of rotation 70 moves from a first location at a first distance 88 from head end 72 of deck support 26 to a second location at a second distance 90 from head end 72 that is less than first distance 88. Thus, according to the presently preferred embodiment, head section 30 both pivots and slides relative to deck support 26. Also during the rotation, shuttles 60 move from a first location at a first distance 94 from axis of rotation 70 to a second location at a second distance 96 from axis of rotation 70 that is greater than the first distance 94.

Although the invention has been described in detail with reference to certain illustrated embodiments, variations exist within the scope and spirit of the invention as described and as defined in the following claims.

What is claimed is:

1. A patient support comprising a frame including a deck support and a deck, the frame having a longitudinal axis, a mattress supported by the deck, and a siderail supported by the frame, the siderail including a rail member, a rail support configured to support the rail member and permit raising and lowering of the rail member relative to the mattress, and a slide configured to support the rail support and slide longitudinally relative to the frame between first and second positions during raising and lowering of the rail member.

2. The patient support of claim 1, wherein the rail support moves with the slide during movement of the slide relative to the frame.

3. A patient support comprising a frame including a deck support and a deck, the deck including a first section and a second section movable relative to the first section, a mattress supported by the deck, and a siderail supported by the frame, the siderail including a rail member, a rail support configured to support the rail member and permit raising and lowering of the rail member relative to the mattress, and a slide configured to support the rail support and slide relative to the frame between first and second positions, and the slide is slidably coupled to the first section of the deck.

4. The patient support of claim 3, further comprising a link extending between the slide and the frame.

5. The patient support of claim 4, wherein the deck is configured to move between first and second configurations, and the link is positioned to control the position of the slide relative to the frame during movement of the deck between the first and second configurations.

6. The patient support of claim 3, wherein the rail support moves with the slide during movement of the slide relative to the frame.

7. A patient support comprising a frame including a deck support and a deck, a mattress supported by the deck, and a siderail supported by the frame, the siderail including a rail member, a rail support configured to support the rail member and permit raising and lowering of the rail member relative to the mattress, and a slide configured to support the rail support and slide relative to the frame between first and second positions, and a link extending between the slide and the frame.

8. The patient support of claim 7, wherein the deck is configured to move between first and second configurations, and the link is positioned to control the position of the slide relative to the frame during movement of the deck between the first and second configurations.

9. The patient support of claim 7, wherein the rail support moves the rail member laterally during raising and lowering thereof.

10. The patient support of claim 7, wherein the rail support moves with the slide during movement of the slide relative to the frame.

11. The patient support of claim 7, wherein the deck is an articulating deck.

12. The patient support of claim 7, wherein the slide is moveable during use of the patient support.

13. A patient support comprising a frame including a deck support and a deck, the frame having a longitudinal axis, a mattress supported by the deck, and a siderail supported by the frame, the siderail including a rail member, a rail support configured to support the rail member and permit raising and lowering of the rail member relative to the mattress, and a slide configured to support the rail support and slide longitudinally relative to the frame between first and second positions, the rail support moving the rail member laterally relative to the deck during raising and lowering thereof.

14. A patient support comprising a frame including a deck support and an articulating deck movable between first and second configurations, a mattress supported by the articulating deck, first and second barriers configured to block egress of a patient from the mattress, and means for moving the first barrier relative to the frame to compensate for movement between the first and second barriers caused by movement of the articulating deck between the first and second configurations.

15. The patient support of claim 14, wherein the moving means includes a slide configured to slide on the frame.

16. The patient support of claim 15, wherein the first barrier is configured to move between a first position blocking egress of a patient from the mattress and a second position permitting egress of a patient from the mattress.

17. The patient support of claim 15, wherein the moving means further includes a linkage coupled to the slide and the deck support.

18. The patient support of claim 14, wherein the deck includes a first section and a second section, the first section moves from a substantially horizontal position when the deck is in the first configuration to an inclined position when the deck is in the second configuration.

19. The patient support of claim 18, wherein the slide is coupled to the first section.

20. The patient support of claim 14, wherein the articulating deck includes a head end and a foot end, a head section of the articulating deck moves from a substantially horizontal position to an inclined position relative to the deck support when the articulating deck is moved to the second configuration.

21. The patient support of claim 20, wherein the moving means moves the first barrier toward the head end of the articulating deck as the head section moves from the horizontal position to the inclined position.

22. A patient support comprising a frame including a deck support, a deck, the deck being movable between first and second configurations, the deck including first and second sections, the first section of the deck moving relative to the second section of the deck during movement of the deck between the first and second configurations, a mattress supported by the deck, and a fixed length siderail supported by the first section of the deck, the siderail being configured to move relative to the first section of the deck during movement of the deck between the first and second positions.

23. The patient support of claim 22, wherein the first section of the deck moves relative to the deck support during movement of the deck between the first and second positions and the siderail is supported by the first section of the deck.

24. The patient support of claim 22, wherein the siderail is movable between a raised position blocking egress of a patient from the mattress and a lowered position permitting egress of a patient from the mattress.

25. A patient support comprising a frame including a deck support and a deck, the deck being movable between first and second configurations, the deck including first and second sections, the first section of the deck moving relative to the second section of the deck during movement of the deck between the first and second configurations, a mattress supported by the deck, and a siderail supported by the frame, the siderail being configured to move relative to the frame during movement of the deck between the first and second positions, the first section of the deck moving relative to the deck support during movement of the deck between the first and second positions, the siderail being supported by the first section of the deck, and the siderail being slidably coupled to the first section of the deck.

26. A patient support comprising a frame including a deck support and a deck, the deck being movable between first and second configurations, the deck including first and second sections, the first section of the deck moving relative to the second section of the deck during movement of the deck between the first and second configurations, a mattress supported by the deck, and a siderail supported by the frame, the siderail being configured to move relative to the frame during movement of the deck between the first and second positions, the siderail being movable between a raised position blocking egress of a patient from the mattress and a lowered position permitting egress of a patient from the mattress and the siderail moving laterally relative to the deck during movement between the raised and lowered positions.

27. The patient support of claim 26, wherein the articulating deck includes a head end and a foot end, a head section of the articulating deck moves from a substantially horizontal position to an inclined position relative to the deck support when the articulating deck is moved to the second configuration.

28. The patient support of claim 26, wherein the siderail is a fixed length siderail.

29. The patient support of claim 26, wherein the siderail moves longitudinally relative to the deck during articulation of the deck between the first and second configurations.

30. A patient support comprising a frame including a deck support and a deck, the deck being movable between first and second configurations, the deck including first and second sections, the first section of the deck moving relative to the second section of the deck during movement of the deck between the first and second configurations, a mattress supported by the deck, and a siderail supported by the frame, the siderail being configured to move relative to the frame during movement of the deck between the first and second positions and the first section of the deck sliding longitudinally relative to the deck support during movement of the deck between the first and second configurations.

31. The patient support of claim 30, wherein the articulating deck includes a head end and a foot end, a head section of the articulating deck moves from a substantially horizontal position to an inclined position relative to the deck support when the articulating deck is moved to the second configuration.

32. The patient support of claim 30, wherein the siderail is a fixed length siderail.

33. The patient support of claim 30, wherein the siderail moves longitudinally relative to the deck during articulation of the deck between the first and second configurations.

34. A patient support comprising a frame including a deck support and a deck, a mattress supported by the deck, and a siderail supported by the frame, the siderail including a rail member, a rail support configured to support the rail member and permit raising and lowering of the rail member relative to the mattress, and a slide comprising a first slide component fixed to the frame and a second slide component configured to slide relative to the frame in response to movement of the deck, the slide configured to support the rail support.

35. The patient support of claim 34, wherein the siderail is movable between a raised position blocking egress of a patient from the mattress and a lowered position permitting egress of a patient from the mattress.

36. A patient support comprising:

a frame including a deck support and a deck, the deck including a first section and a second section, the first section moves from a substantially horizontal position when the deck is in a first configuration to an inclined position when the deck is in a second configuration, a mattress supported by the deck, and a siderail supported by the frame, the siderail including a rail member, a rail support configured to support the rail member and permit raising and lowering of the rail member relative to the mattress, and a slide comprising a first slide component fixed to the frame and a second slide component configured to slide relative to the frame, the slide configured to support the rail support.

37. The patient support of claim 36, wherein the slide is coupled to the first section.

38. A patient support comprising:

a frame including a deck support and a deck, a mattress supported by the deck, and a siderail supported by the frame, the siderail including a rail member, a rail support configured to support the rail member and permit raising and lowering of the rail member relative to the mattress, and a slide comprising a first slide component fixed to the frame and a second slide component configured to slide relative to the frame, the slide configured to support the rail support, the rail support moving the rail member laterally relative to the deck during raising and lowering thereof.

39. A patient support comprising a frame including a deck support and an articulating deck, a mattress supported by the deck, and a siderail supported by the frame, the siderail including a rail member, a rail support configured to support the rail member and permit raising and lowering of the rail member relative to the mattress, and a slide configured to support the rail support and slide relative to the frame between first and second positions in response to movement of the deck.

40. The patient support of claim 39, wherein the rail support moves with the slide during movement of the slide relative to the frame.

41. A patient support comprising:

a frame including a deck support and an articulating deck, the deck including a first section and a second section movable relative to the first section, a mattress supported by the deck, and a siderail supported by the frame, the siderail including a rail member, a rail support configured to support the rail member and permit raising and lowering of the rail member relative to the mattress, and a slide configured to support the rail support and slide relative to the frame between first and second positions, the slide being slidably coupled to the first section of the deck.

42. A patient support comprising a frame including a deck support and an articulating deck, a mattress supported by the deck, a siderail supported by the frame, the siderail including a rail member, a rail support configured to support the rail member and permit raising and lowering of the rail member relative to the mattress, and a slide configured to support the rail support and slide relative to the frame between first and second positions, and a link extending between the slide and the frame.

43. The patient support of claim 42, wherein the deck is configured to move between first and second configurations, and the link is positioned to control the position of the slide relative to the frame during movement of the deck between the first and second configurations.

44. A patient support comprising a frame including a deck support and an articulating deck, a mattress supported by the deck, and a siderail supported by the frame, the siderail including a rail member, a rail support configured to support the rail member and permit raising and lowering of the rail member relative to the mattress, and a slide configured to support the rail support and slide relative to the frame between first and second positions, the rail support moves the rail member laterally relative to the deck during raising and lowering thereof.

45. A patient support comprising a frame including a deck support and a deck, a mattress supported by the deck, and a siderail supported by the frame, the siderail including a rail member, a rail support configured to support the rail member and permit raising and lowering of the rail member relative to the mattress, and means to support the rail support and slide relative to the frame between first and second positions, in response to movement of the deck.

46. The patient support of claim 45, wherein the rail support moves with the support and slide means during movement of the support and slide means relative to the frame.

47. A patient support comprising a frame including a deck support and a deck, the deck including a first section and a second section movable relative to the first section, a mattress supported by the deck, and a siderail supported by the frame, the siderail including a rail member, a rail support configured to support the rail member and permit raising and lowering of the rail member relative to the mattress, and means to support the rail support and slide relative to the frame between first and second positions the support and slide means being coupled to the first section of the deck.

48. A patient support comprising a frame including a deck support and a deck, a mattress supported by the deck, a siderail supported by the frame, the siderail including a rail member, a rail support configured to support the rail member and permit raising and lowering of the rail member relative to the mattress, and means to support the rail support and slide relative to the frame between first and second positions, and a link extending between the support and slide means and the frame.

49. The patient support of claim 48, wherein the deck is configured to move between first and second configurations, and the link is positioned to control the position of the support and slide means relative to the frame during movement of the deck between the first and second configurations.

50. A patient support comprising a frame including a deck support and a deck, a mattress supported by the deck, and a siderail supported by the frame, the siderail including a rail member, a rail providing a siderail supported by the frame, the siderail including a rail member, a rail support configured to support the rail member and permit raising and lowering of the rail member relative to the mattress, and a slide configured to support the rail support, and sliding the siderail from a first blocking position to a second blocking position.

51. A patient support comprising a frame including a deck support and a deck, a mattress supported by the deck, and a siderail supported by the frame, the siderail including a rail member, a rail support configured to support the rail member and permit raising and lowering of the rail member relative to the mattress, and a slide configured to support the rail support, the siderail configured to slide between a first blocking position and a second blocking position.

52. The patient support of claim 51, wherein the rail support moves the rail member laterally during raising and lowering thereof.

53. The patient support of claim 51, wherein the rail support moves with the slide during movement of the slide relative to the frame.

54. A patient support comprising a frame including a deck support and a deck, the deck including a first section and a second section movable relative to the first section, a mattress supported by the deck, and a siderail supported by the frame, the siderail including a rail member, a rail support configured to support the rail member and permit raising and lowering of the rail member relative to the mattress, and a slide configured to support the rail support, the siderail having a first use position and a second use position the slide being slidably coupled to the first section of the deck.

55. A patient support comprising a frame including a deck support and a deck, a mattress supported by the deck, a siderail supported by the frame, the siderail including a rail member, a rail support configured to support the rail member and permit raising and lowering of the rail member relative to the mattress, and a slide configured to support the rail support, and a link extending between the slide and the frame, the siderail having a first use position and a second use position.

56. The patient support of claim 55, wherein the deck is configured to move between first and second configurations, and the link is positioned to control the position of the slide relative to the frame during movement of the deck between the first and second configurations.

57. A patient support comprising a frame including a deck support and a deck, the deck being movable between first and second configurations, the deck including first and second sections, the first section of the deck moving relative to the second section of the deck during movement of the deck between the first and second configurations, a mattress supported by the deck, and a fixed length siderail supported by the frame, the fixed length siderail being configured to move relative to the frame during movement of the deck between the first and second positions.

58. The patient support of claim 57, wherein the first section of the deck moves relative to the deck support during movement of the deck between the first and second position and the fixed length siderail is supported he first section of the deck.

59. The patient support of claim 58, wherein the fixed length siderail is slidably to the first section of the deck.

60. The patient support of claim 57, wherein the fixed length siderail is movable between a raised position blocking egress of a patient from the mattress and a lowered position permitting egress of a patient from the mattress.

61. The patient support of claim 60, wherein the fixed length siderail moves laterally during movement between the raised and lowered positions.

62. The patient support of claim 57, wherein the first section of the deck slides longitudinally relative to the deck support during movement of the deck between the first and second configurations.

63. A method of supporting a patient comprising providing a frame including a deck support and a deck, providing a mattress supported by the deck, a siderail supported by the frame, the siderail including a rail member, a rail support configured to support the rail member and permit raising and lowering of the rail member relative to the mattress, and a slide configured to support the rail support and slide relative to the frame between first and second positions, the rail support moves the rail member laterally relative to the deck during raising and lowering thereof.

64. The method of claim 63, wherein the rail support moves the rail member laterally during raising and lowering thereof.

65. The method of claim 63, wherein the rail support moves with the slide during movement of the slide relative to the frame.

66. A method of supporting a patient comprising providing a frame including a deck support and a deck, the deck including a first section and a second section movable relative to the first section, providing a mattress supported by the deck, providing a siderail supported by the frame, the siderail including a rail member, a rail support configured to support the rail member and permit raising and lowering of the rail member relative to the mattress, and a slide configured to support the rail support, the slide being slidably coupled to the first section of the deck, and moving the siderail from a first use position to a second use position.

67. A method of supporting a patient comprising providing a frame including a deck support and a deck, providing a mattress supported by the deck, providing a siderail supported by the frame, the siderail including a rail member, a rail support configured to support the rail member and permit raising and lowering of the rail member relative to the mattress, and a slide configured to support the rail support, providing a link extending between the slide and the frame, moving the siderail from a first use position to a second use position.

68. The method of claim 67, wherein the deck is configured to move between first and second configurations, and the link is positioned to control the position of the slide relative to the frame during movement of the deck between the first and second configurations.

* * * * *